US006176738B1

(12) United States Patent
Consoli et al.

(10) Patent No.: US 6,176,738 B1
(45) Date of Patent: Jan. 23, 2001

(54) BLIND MATABLE PANEL MOUNT CONNECTOR SYSTEM

(75) Inventors: John Joseph Consoli, Harrisburg; Lynn Robert Sipe, Lewistown, both of PA (US)

(73) Assignee: The Whitaker Corporation, Wilmington, DE (US)

( * ) Notice: Under 35 U.S.C. 154(b), the term of this patent shall be extended for 0 days.

(21) Appl. No.: 09/228,165

(22) Filed: Jan. 11, 1999

Related U.S. Application Data

(60) Provisional application No. 60/073,133, filed on Jan. 30, 1998.

(51) Int. Cl.[7] ..... H01R 13/73

(52) U.S. Cl. ..... 439/545; 439/552

(58) Field of Search ..... 439/545, 552, 439/549, 557, 247, 248, 560, 562

(56) References Cited

U.S. PATENT DOCUMENTS

| | | | |
|---|---|---|---|
| 3,912,355 | 10/1975 | Curado et al. | 339/128 |
| 3,995,947 | 12/1976 | Lightner et al. | 339/92 M |
| 4,029,385 | 6/1977 | Mysiak et al. | 339/128 |
| 4,029,953 | 6/1977 | Natoli | 240/8.16 |
| 4,077,693 | 3/1978 | Briel, Jr. et al. | 339/126 R |
| 4,148,542 | 4/1979 | Wood | 339/126 RS |
| 4,352,538 | 10/1982 | Fowler | 339/126 R |
| 4,541,036 | 9/1985 | Landries et al. | 361/426 |
| 4,647,130 | 3/1987 | Blair et al. | 339/64 M |
| 4,761,144 | 8/1988 | Hunt, III et al. | 439/545 |
| 4,812,133 | 3/1989 | Fleak et al. | 439/248 |
| 4,824,387 | 4/1989 | deJong et al. | 439/248 |
| 4,921,426 | 5/1990 | Kawasaki et al. | 439/34 |
| 4,921,435 | 5/1990 | Kane et al. | 439/248 |
| 4,936,786 | 6/1990 | Klein et al. | 439/76 |
| 4,990,094 | 2/1991 | Chandler et al. | 439/108 |
| 5,002,497 | 3/1991 | Plocek et al. | 439/248 |
| 5,017,151 | 5/1991 | Peterson | 439/248 |
| 5,127,852 | 7/1992 | Cravens et al. | 439/545 |
| 5,184,964 | 2/1993 | Douty et al. | 439/247 |
| 5,228,865 | 7/1993 | Douty et al. | 439/247 |
| 5,407,363 | 4/1995 | Polgar et al. | 439/546 |
| 5,514,000 | 5/1996 | Krause et al. | 439/248 |
| 5,575,673 | 11/1996 | Dahlem et al. | 439/248 |
| 5,620,329 | 4/1997 | Kidd et al. | 439/248 |
| 5,622,511 | 4/1997 | Jarrett | 439/248 |
| 5,795,185 | 8/1998 | Edgley et al. | 439/545 |

OTHER PUBLICATIONS

U.S. Ser. No. 09/104,407, filed Jun. 25, 1998 (Abstract and drawing only).

*Primary Examiner*—Paula Bradley
*Assistant Examiner*—Katrina Davis

(57) ABSTRACT

A connector (10) is provided that is mountable in cutout (82) of a panel (80) and incrementally movable therein. First flanges (30) of a first layer (28) pass through recesses (84) along sides of the cutout (82) until second flanges (38) of a second layer (36) abut the near surface of the panel adjacent the recesses. The connector is then translated laterally to a fully mounted position until stop member (44) seats in a locking position with respect to an edge (96) of the cutout, thus maintaining the connector in its fully mounted position with first and second flange layers sandwiching portions of the panel therebetween, and preventing the connector from moving inadvertently to its initially inserted position. Mating connectors (10,100) mounted on respective panels (80, 170) define an ultra low mated height permitting the panels to be very close together.

20 Claims, 7 Drawing Sheets

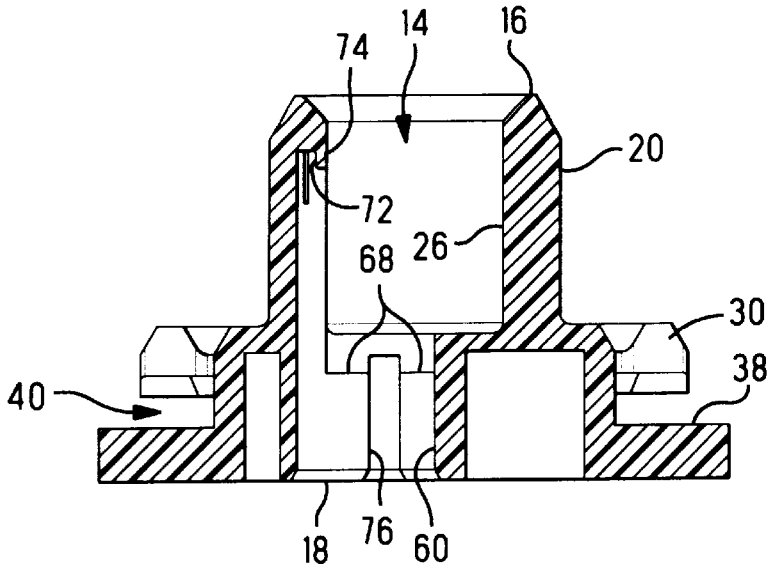
FIG. 9
FIG. 10
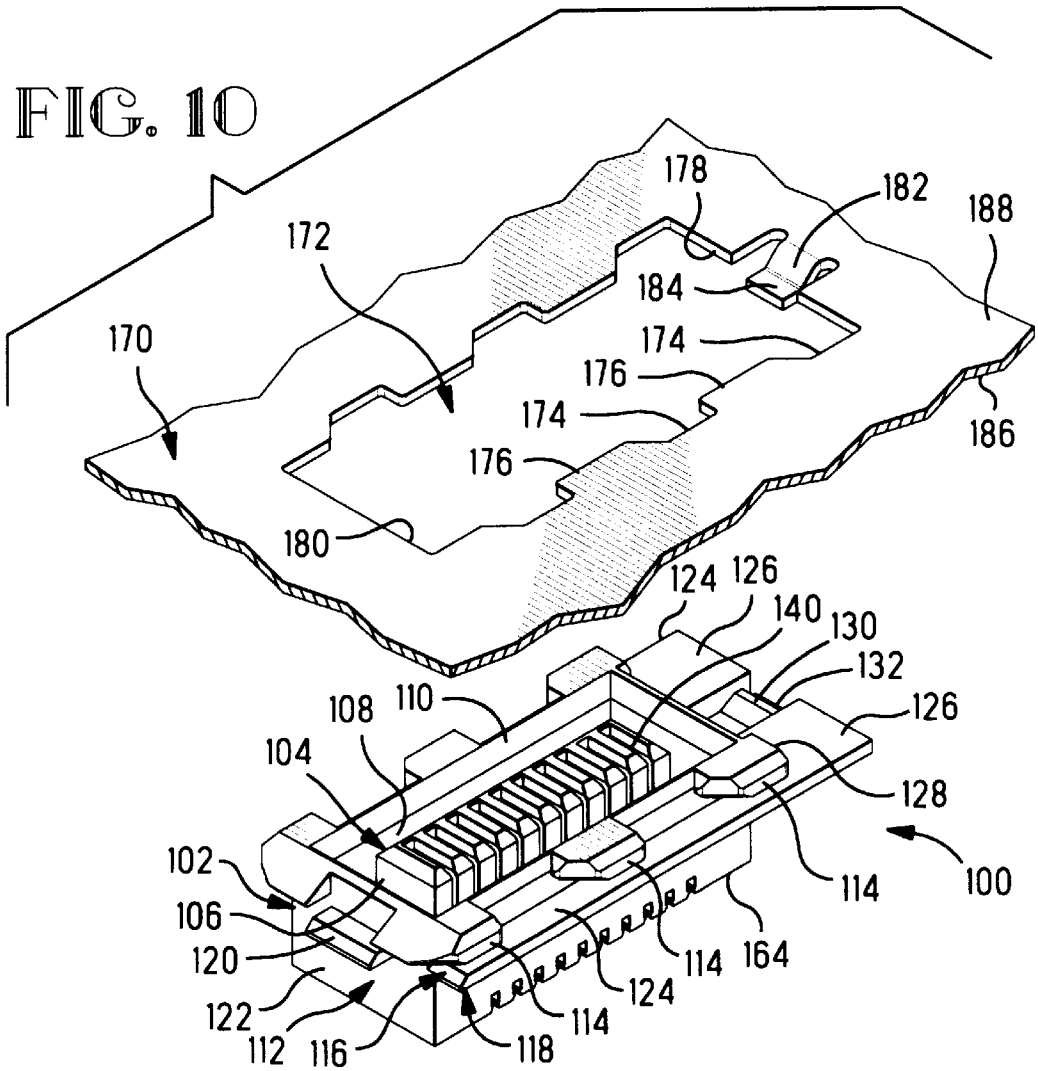

BLIND MATABLE PANEL MOUNT CONNECTOR SYSTEM

This application claims the benefit of U.S. Provisional Application No. 60/073,133, filed on Jan. 30, 1998.

FIELD OF THE INVENTION

This relates to the field of electrical connectors and more particularly to connectors mountable to panels.

BACKGROUND OF THE INVENTION

Various approaches have been used to mount electrical connectors to panels to extend through a panel cutout such that a mating face is exposed on one side of the panel and the connector extends to another face on the opposite side of the panel, and circuits are completed from one panel side to the other. One technique is to secure the connector to the panel by fasteners that extend through aligned holes of the panel and flanges extending laterally from the sides of the connector and lying adjacent the panel. Another technique is disclosed in U.S. Pat. Nos. 3,995,947 and 5,002,497 in which the connector is secured to the panel without the use of discrete fasteners, using features of the connector housing or shell to cooperate with the panel.

In U.S. Pat. Nos. 4,077,693; 4,352,538 and 5,407,363, connectors include flanges in a first layer that pass through recesses along the cutout periphery until moved past the far panel surface whereupon second flanges or bosses of the housing laterally and axially staggered from the flanges of the first layer abut the near panel surface. The connector is then translated or rotated laterally to a mounted position so that the first flanges are no longer aligned with the recesses through which they past, and the connector is locked in the mounted position such as by a separate key member, or a latch arm integral with the housing cooperating with a panel feature. In U.S. Pat. No. 5,407,363, limited float is available to the connector within the cutout for the connector to adjust its position incrementally during connector mating.

It is desired to provide a connector that selfretains to a panel at a cutout thereof, in a manner that permits floating incrementally in at least two dimensions upon mating with a mating connector along the mating face.

It is further desired to provide such a connector that is permitted to float incrementally in three dimensions.

SUMMARY OF THE INVENTION

The present invention is a connector mounting system of a connector and a panel cutout, with the connector having an insulative housing for being mounted to a panel to extend through the cutout and selfretain to the panel, without fasteners, in a manner permitting incremental movement in at least two dimensions (laterally) and preferably in three dimensions (laterally and axially). The connector of the system provides all panel-associated features in an axially compact, low profile arrangement on an easily moldable one-piece housing.

Extending from opposed side walls of the housing are tablike flanges staggered laterally therealong arrayed in a single first layer adjacent the leading end of the housing, that pass through corresponding recesses along the periphery of the panel cutout. Ledges such as arrays of second flanges also extend from each of the opposed side walls as a second layer and are spaced axially rearwardly from the first layer of flanges a distance slightly greater than a panel thickness, and abut the panel adjacent the cutout periphery to stop further axial insertion. Thereafter, the connector is translated laterally until the free end of a resilient beam at one end of the housing resiles from its deflected position after passing a stop surface of the panel along the cutout periphery. The free end has a stop surface aligning with the panel stop surface and is abuttable thereagainst, preventing translation of the connector to its initial position.

The cutout is dimensioned to be larger than the housing to permit not only movement of the housing between two lateral positions but also being sufficiently large to permit incremental movement of the housing within the cutout after the stop surface of the resilient beam has become aligned with the corresponding stop surface of the panel. Incremental axial movement of the connector in its mounted position is permitted by the spacing between the flange layers being greater than the panel thickness.

The connector and panel cutout preferably are polarized to assure that panel mounting occurs only when the connector is in a single desired orientation to assure that the stop surface cooperates with the panel stop surface; polarization may be by shaping the tablike flanges and the panel tabs between the recesses, so that the tablike flanges only pass by the tabs when the connector is in the desired orientation. The ledges or second layer of flanges is preferably an array of elongate tablike flanges sufficiently long to abut the second panel surface outwardly of the outermost cutout extent; optionally, the flanges may be continuous along each housing side to assuredly abut the second panel surfaces of all the panel tabs along the respective side.

In one particular application, a pair of matable connectors are each mounted to a respective panel as described above, where the panels are moved toward each other and whereupon the connectors mate. Each connector is float mounted to incrementally adjust position to become mutually aligned, and to assure that their contacts will thereafter become electrically engaged without damage. One connector preferably has blade-like contacts and the other has receptacle contacts complementary to the blade-like contacts.

Embodiments of the present invention will now be described by way of example with reference to the accompanying drawings.

BRIEF DESCRIPTION OF THE DRAWINGS

FIG. 9 is a cross-sectional view of the housing of the connector of FIGS. 1 to 7;

FIGS. 10 and 11 are isometric views of a second connector matable with the connector of FIGS. 1 to 9, spaced from and mounted to a panel cutout therefor, respectively;

DETAILED DESCRIPTION

Figure 1:
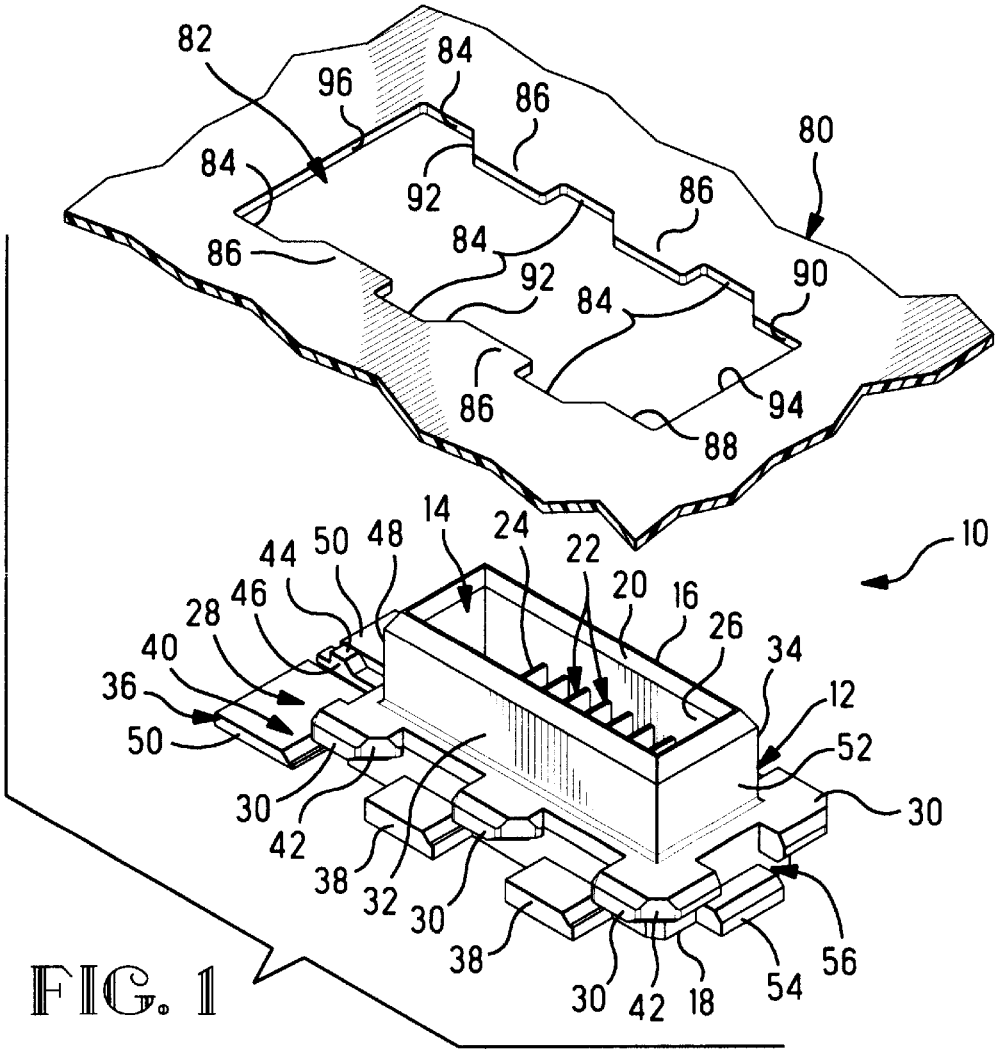
FIG. 1 is an isometric view of a first connector spaced from the cutout of a panel.
Figure 2:
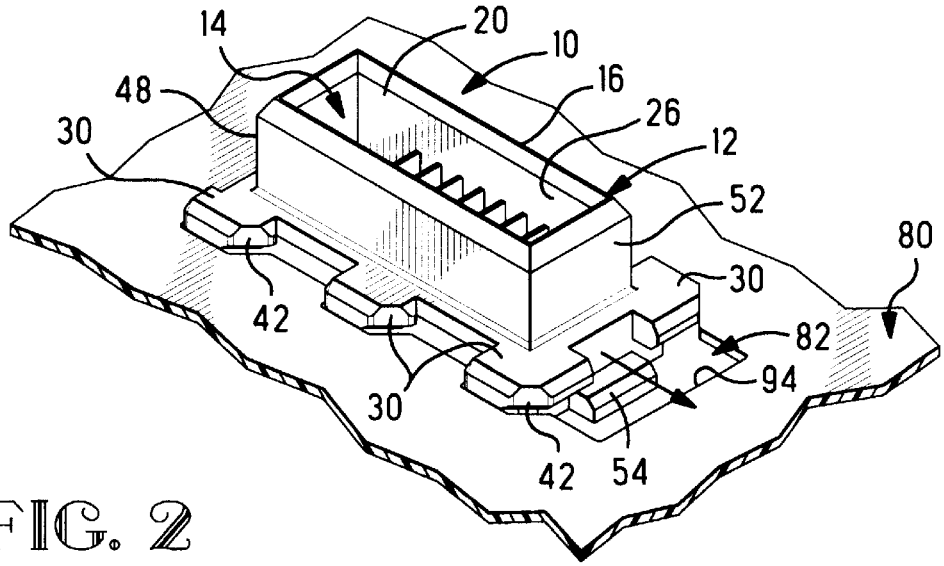
FIG. 2 is an isometric view similar to FIG. 1 with the connector partially inserted into the cutout.
Figure 3:
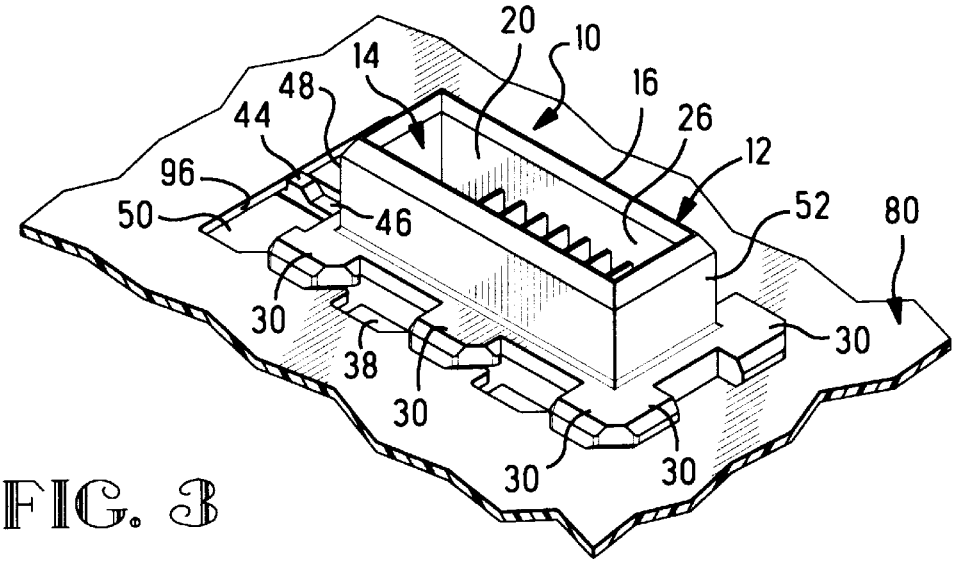
FIG. 3 is an isometric view showing the first connector fully inserted into the cutout and locked in place.
Figure 4:
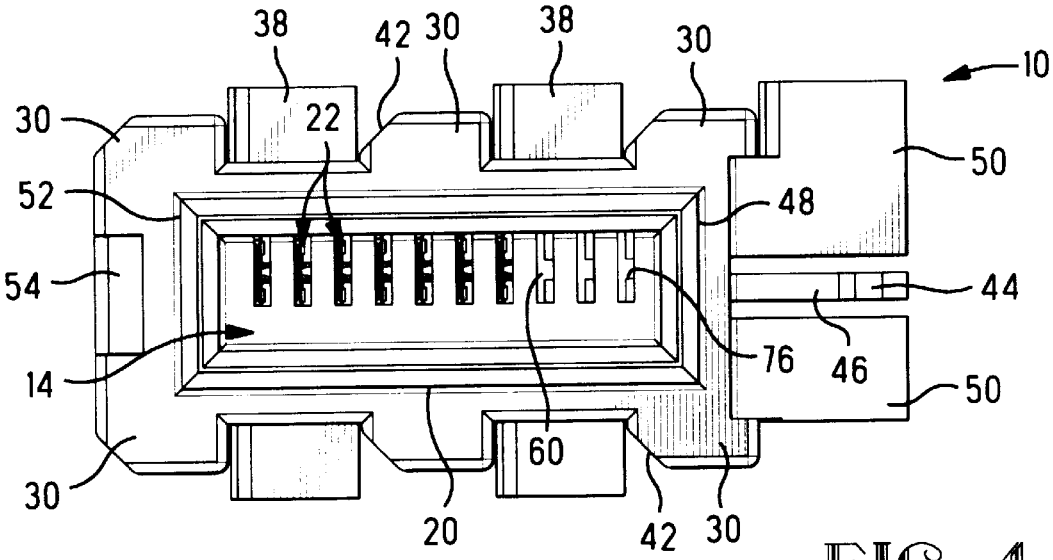
FIGS. 4 and 5 are plan and elevation views of the connector of FIGS. 1 to 3.

Connector 10 of FIGS. 1 to 9 includes a housing 12 that defines a mating face 14 at a leading end 16, and a rearward face 18. Mating face 14 includes a shroud 20 surrounding a plurality of contacts 22 retained within housing 12, the contacts including blade-like contact sections 24 exposed within cavity 26 recessed from leading end 16. In FIGS. 1 to 7, several contact positions are shown without contacts therein, to illustrate detail of the cavities. A first layer 28 of tablike flanges 30 is defined proximate the leading end 16, extending laterally from opposed sides 32,34; and a second layer 36 of elongate tablike second flanges or ledges 38 is defined spaced rearwardly a selected distance or gap 40 from first layer 28 and proximate rearward face 18. Gap 40 is preferably slightly greater than the thickness of panel 80 to facilitate translation and also to permit incremental axial movement of the connector during mating, and is more clearly seen in FIG. 7. Second flanges 38 preferably are longer than first flanges 30, as best seen in FIG. 4.

Panel 80 has a cutout 82, recesses 84 alternating with tabs 86 along opposed sides 88,90 about the periphery of the cutout. Recesses 84 include angled sides 92, and complement the shape of first flanges 30 of connector 10 that are chamfered at corners 42; the angled recess sides and chamfers are seen to be along the same sides of the recesses and flanges on each side, with one side of the connector and the cutout being a mirror image of the other side thereof for polarization requiring that the connector be inserted when in only one orientation.

Connector 10 includes a stop member such as latch 44 disposed on the leading end of a resilient beam 46 extending from end 48 of housing 12, with the beam coplanar with second layer 36 of second flanges 38. Latch 44 is an embossment projecting from the forward surface of beam 46. Shown extending beside beam 46 from end 48 are flaps 50, also generally coplanar with second flange layer 36, that will close off the exposed cutout portion when the connector is moved to its fully mounted position. Extending from opposite end 52 of housing 12 is seen a short flange 54, again coplanar with second flange layer 36. It may be seen that first flanges 30 adjacent opposite housing end 52 also extend beyond end 52 to define a gap 56 with respect to short flange 54, with gap 56 being of equal dimension to gap 40.

Referring to FIG. 2, leading end 16 of connector 10 has been inserted through cutout 82 from the second panel side to the first panel side, with first flanges 30 passing through recesses 84 of the panel cutout. Flaps 50 are hidden behind the panel adjacent to end 96 thereof, and second flanges 38 are similarly hidden. It is seen that first flanges 30 have the corner edges thereof chamfered to facilitate insertion through the recesses.

When connector 10 has been pushed fully such that first flanges 30 have passed completely through recesses 84 and second flanges 38 and flaps 50 are now adjacent the surface of the second side of panel 80, connector 10 is then urged laterally toward end 94 of cutout 82 from a first lateral position to a second or fully mounted lateral position as shown in FIG. 3. First flanges 30 pass atop adjacent ones of tabs 86 adjacent to the first panel side and also to the panel adjacent to end 94, and the periphery of the panel cutout is disposed in gaps 40 and 56.

Figure 6:
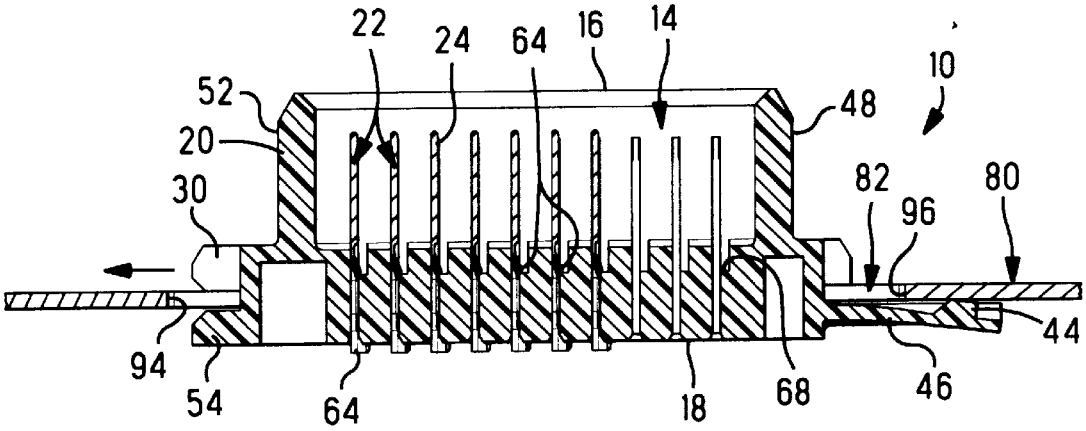
FIGS. 6 and 7 are enlarged cross-section views showing the latch of the connector of FIGS. 1 to 3 before and after latching with the panel.
Figure 7:
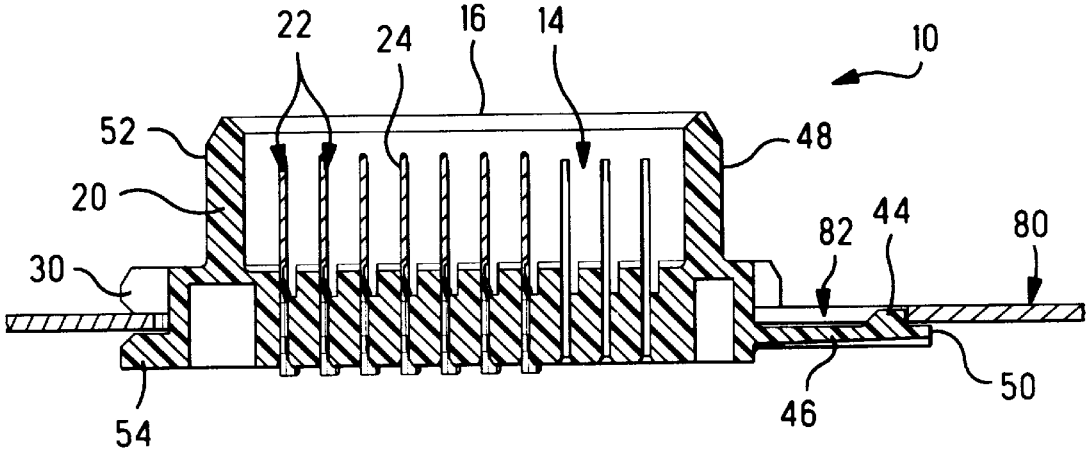

When connector 10 has been translated to its fully mounted lateral position, the stop surface of latch 44 seats adjacent to end 96 of cutout 82 (end 96 defining a locking edge) when beam 46 resiles, as illustrated in FIGS. 6 and 7. With latch 44 in its seated position, any substantial inadvertent movement of connector 10 laterally toward its first lateral position is prevented. However, it is seen that latch 44 may be delatched from the panel by deflection of beam 46, to enable unmounting of the connector from the panel for service and repair.

Figure 5:
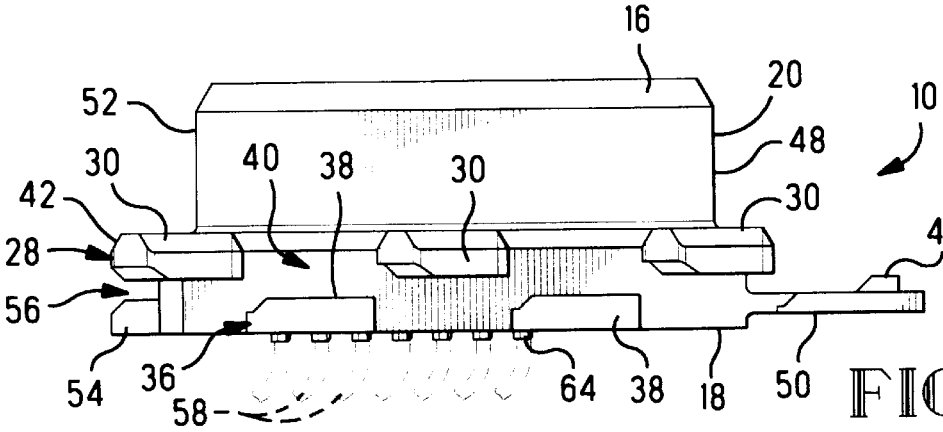

In FIG. 4, it is seen that respective ones of second flanges 38 are located between first flanges 30, and short flange 54 is located between the first flanges 30 at connector end 52. Such arrangement facilitates molding the insulative connector housing in a two-draw mold for minimized production costs. In FIG. 5, lower corner edges of first flanges 30 and upper corner edges of second flanges 38 are seen to be chamfered to facilitate translation of the connector from the first lateral position to the second lateral position, as portions of the panel are received into gaps 40 and 56. Shown in phantom are conductor wires 58 extending from rear face 18 of connector 10.

Figure 8:
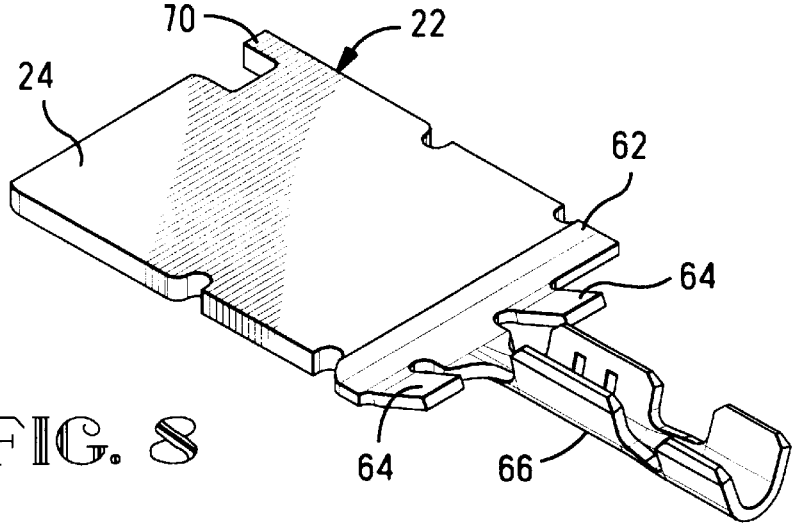
FIG. 8 is an isometric view of a contact of the connector of FIGS. 1 to 5.
Figure 11:
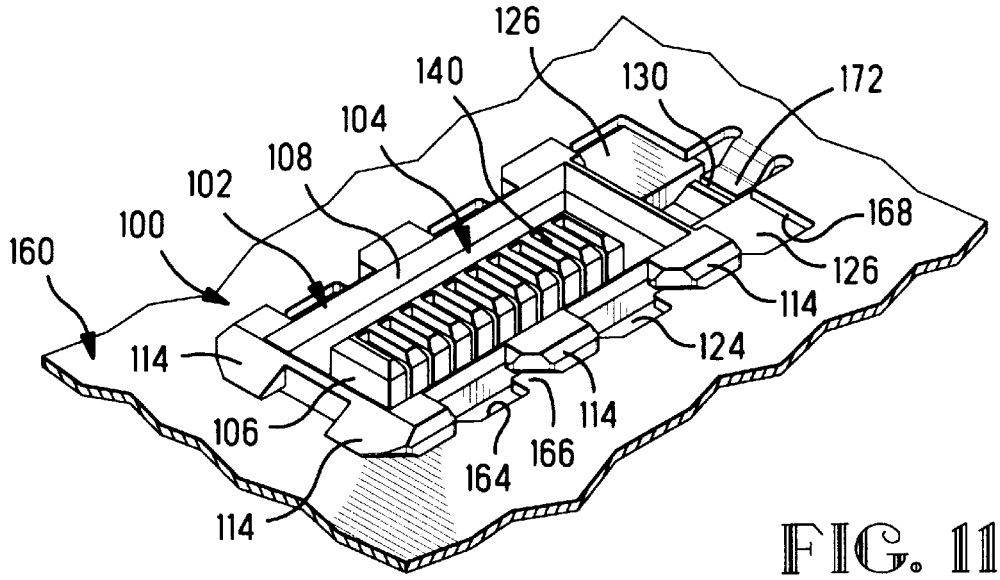
Figure 12:
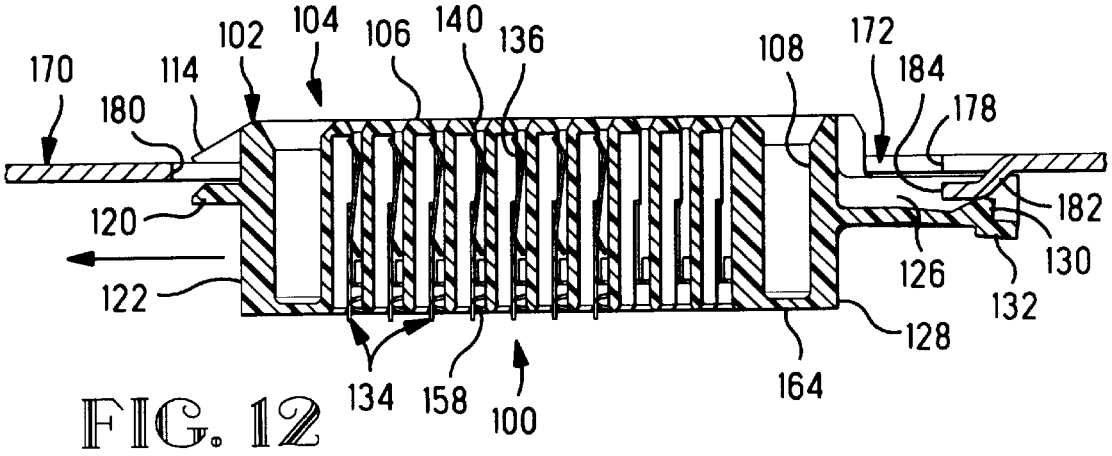
FIGS. 12 and 13 are enlarged cross-sectional views of the latch of the connector of FIGS. 10 and 11 before and after latching with a locking tab of the panel.

A contact 22 is shown in FIG. 8 and a contact-receiving cavity 60 is seen in FIG. 9. Contact 22 has a planar or blade-like contact section 24, a body section 62 with retention tabs 64, and a connecting section 66 that is adapted to be crimped onto a stripped end of a conductor wire 58 (FIG. 5). Retention tabs 64 will seat atop a forwardly facing ledge 68 along the contact-receiving cavity 60 during insertion from rear face 18. A post portion 70 is seen extending from the forward end of contact section 24, to seat within a rearwardly facing recess 72 of lip 74 of the housing extending from a side wall of the shroud 20 proximate leading end 16, to stabilize the contact during mating and unmating, and to resist forward movement of the contact during unmating. Extending into housing 12 from rear face 18 is a cavity portion 76 that extends longitudinally from contact-receiving cavity 60, as seen in FIGS. 4 and 9, for receipt thereinto of wire-connecting section 66 after being crimped onto a stripped end of a wire 58 (FIG. 5).

Second connector 100 of FIGS. 10 to 15 is matable with connector 10 of FIGS. 1 to 9. Second connector 100 is a receptacle connector having an insulative housing 102 having a mating face 104 complementary to mating face 14 of receptacle connector 10, wherein a plug portion 106 of housing 102 is receivable into cavity 26 of housing 12 while a shroud-receiving cavity 108 surrounds plug portion 106 for receipt thereinto of shroud 20 of housing 12. Provided at leading end 110 is a first layer 112 of first tablike flanges 114 spaced by a gap 116 from a second layer 118 of second flanges or ledge 120, 124 similarly to connector 10 of FIGS. 1 to 9. Second flange layer 118 is seen to comprise an end flange 120 at second housing end 122 and a single second flange 124 extending continuously along each housing side and terminating in a flap section 126 adjacent first housing end 128 that close off the otherwise exposed portion of the panel cutout upon full mounting of connector 100 (see FIG. 11).

Figure 13:
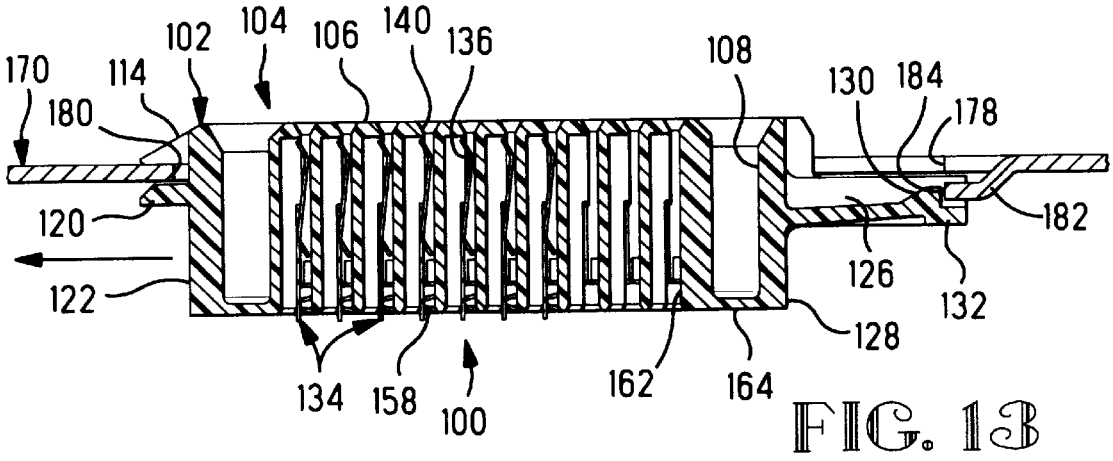
Figure 14:
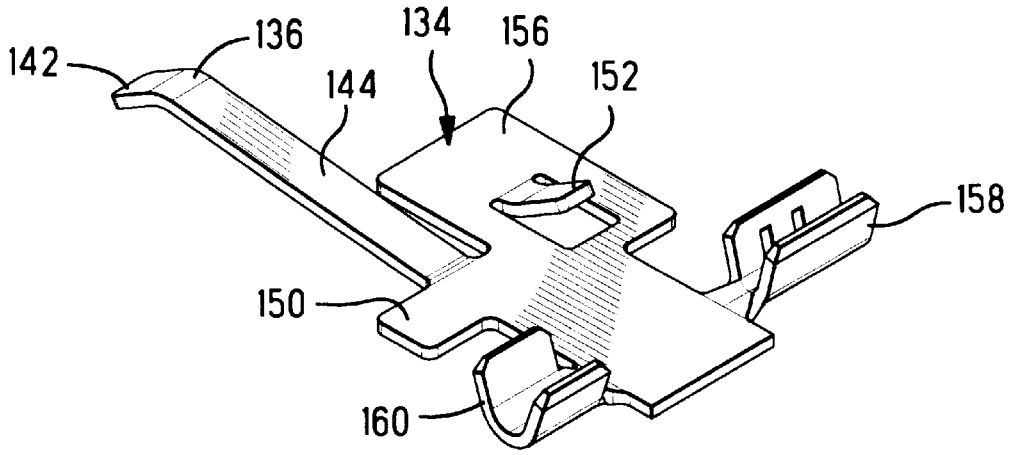
FIG. 14 is an isometric view of a contact of the connector of FIGS. 10 and 11.
Figure 15:
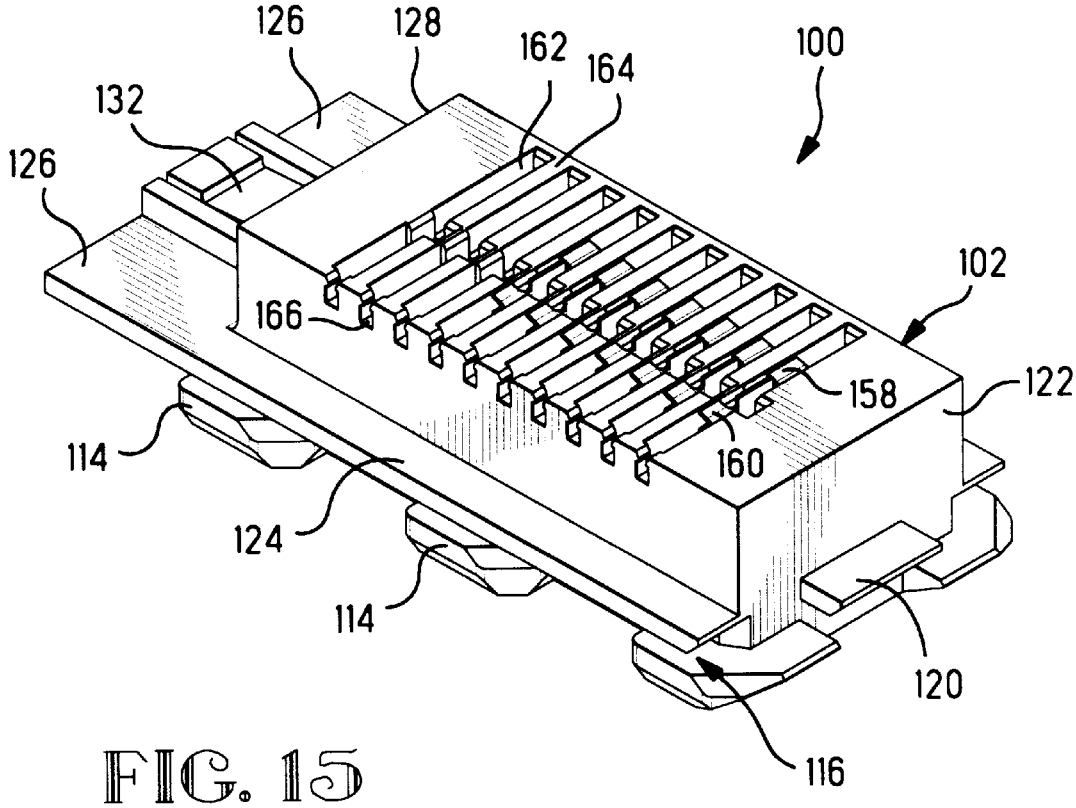
FIG. 15 is an isometric view of the rear face of the connector of FIGS. 10 and 11.

Second connector 100 also includes a latch 130 extending from a leading surface of beam 132 at first housing end 128. Panel 170 includes a cutout 172 having alternating recesses 174 and tabs 176 disposed along each side from first end 178 to second end 180. Panel 170 also includes a locking tab 182 struck outwardly from the panel adjacent first end 178 and having a free end 184 that will cooperate with latch 130 upon mounting of connector 100 in cutout 172 as is demonstrated in FIGS. 11 to 13. Locking tab 182 is struck out of the plane of the panel and beyond second panel surface 186, thereby enabling latch 130 to be recessed below first panel surface 188, as seen in FIG. 13. This arrangement permits connector 100 to define an ultra low profile extending from second panel surface 188, allowing panel 170 to be positioned very closely to panel 80 when the connectors are mated.

Housing 102 contains a plurality of female contacts 134 (FIGS. 12 to 16) with blade-engaging contact sections 136 disposed in respective cavities 138 recessed from blade-receiving entrances 140 extending rearwardly from mating face 104, within a plug portion 106 complementary with cavity 24 of shroud 20 of connector 10. In FIGS. 12 to 15, several contact positions are shown without contacts therein to reveal details of the cavities. Blade-engaging contact section 136 is seen to be proximate to a free end 142 of an elongate spring arm 144, and positioned to be aligned with the blade-receiving entrance to be assuredly engaged by a mating blade-like contact section during connector mating (see FIG. 16). Preferably free end 142 of the spring arm 144 is retained in a pocket 146 at the leading end of the cavity adjacent the blade-receiving entrance and spring biased toward the entrance and against a lip 148, thus assuring precise positioning of the contact section in alignment with the entrance.

Body section 150 of contact 134 is disposed within cavity 138 and retained therein by a retention lance 152 seated atop a ledge 154 (FIG. 16), and includes a stabilizing portion 156. A connecting section 158 is adapted to be crimped onto the stripped end of a conductor wire (not shown), while a strain relief section 160 is adapted to be crimped onto the insulation jacket of the wire. The connecting section 158 and the strain relief section 160 are oriented orthogonal to the direction of mating of the connectors and are seated in recesses 162 parallel to rear face 164, so that the wires will exit the connector orthogonal to rear face 164. Exits 166 of the recesses may be narrow to grip the wire and maintain it in position along the recess.

Figure 16:
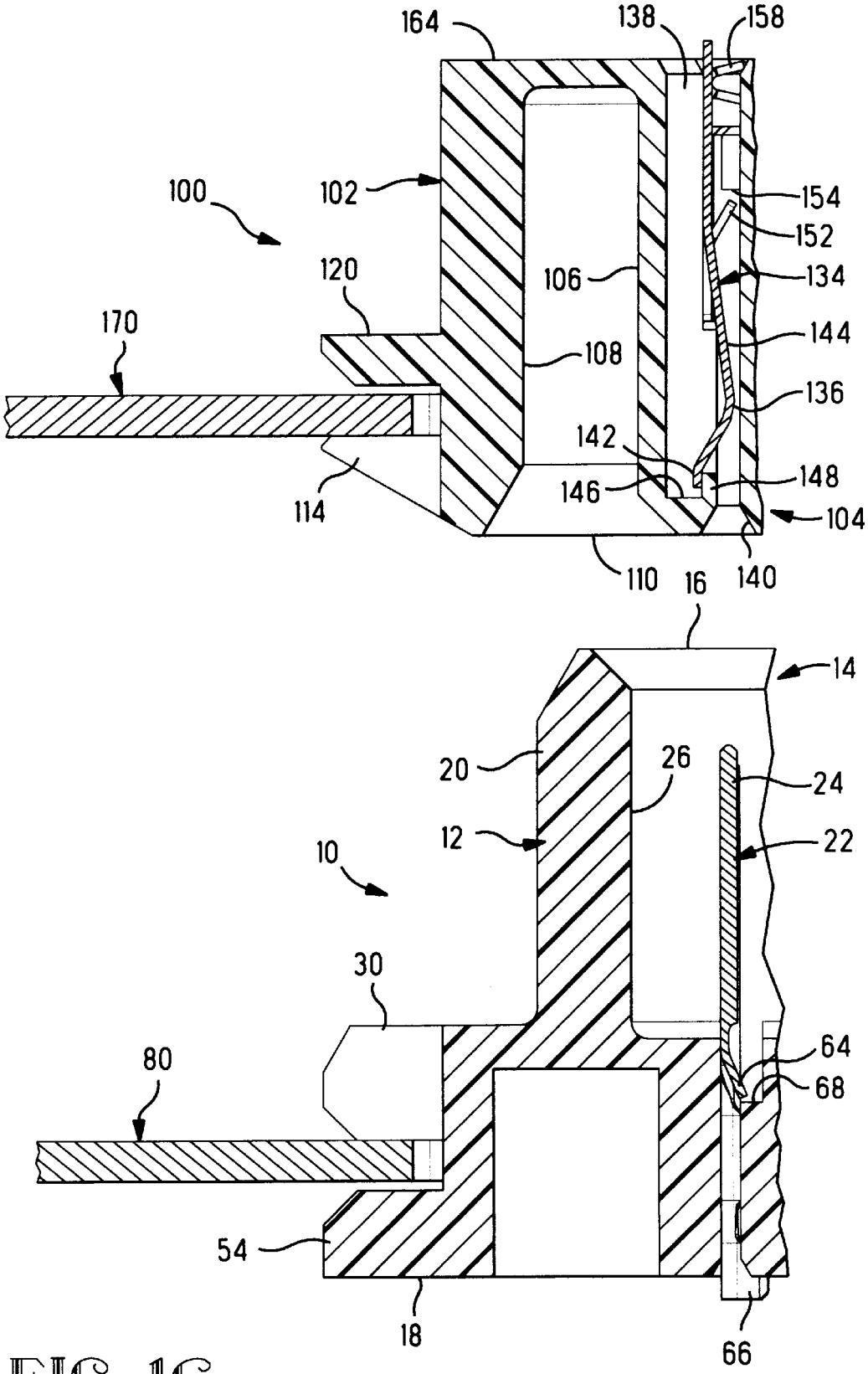
FIG. 16 is cross-sectional view of portions of the connectors of FIGS. 1 to 15 prior to being mated, showing the contacts of the connectors prior to engagement.

Referring to FIG. 16, it is seen that upon mating of connectors 10 and 100, their respective panels 80,170 will be spaced apart only a distance equal to the height of the first layers of flanges. It is preferred that the leading ends of the shroud 20 and plug portion 106, and the entrances to the shroud-receiving cavity 108 and cavity 26, are generously chamfered to facilitate blind mating. The connectors therefor define an ultra low mated profile. Preferably the panel cutouts are dimensioned to be 1.4 mm greater than the distance between the latching surface of latches 44, 130 and the opposed end of housings 12,102 thus permitting incremental translational adjustment by each connector upon mating. Similarly, it is preferred that the cutout be about 1.4 mm wider than the widths of the housings, and that the gaps between the first and second flange layers of the housings be about 0.3 mm greater than the panel thicknesses. The housings may be made for example from a thermoplastic resin such as polybutylene terephthalate to be provided with durability.

Variations and modifications to the present invention may be devised that are within the spirit of the invention and the scope of the claims.

What is claimed is:

1. An electrical connector for mounting to a panel having first and second sides and having a cutout having opposed side edges and opposed first and second end edges, comprising:

an insulative housing having a first face and a second face corresponding to said first and second sides, said housing having opposed side walls and opposed first and second end walls and being dimensioned smaller than said cutout;

said side walls each including at least one first flange extending outwardly therefrom proximate said first face corresponding to a recess in said cutout with said at least one first flange defining a coplanar panel-abutting surface facing said second face, and said side walls further each including a ledge extending outwardly therefrom closer to said second face than said at least one first flange and spaced from said at least one first flange a distance at least as great as a thickness of said panel to define a panel-receiving gap between said at least one first flange and said ledge, said ledge defining a coplanar panel-abutting surface facing said first face that extends beyond side edges of said at least one first flange to abut said second side beside said recess when said connector is inserted through said panel from said second side;

said housing having a length between said opposed first and second end walls substantially less than a corresponding dimension of said cutout between said first end edge and said second end edge such that said housing is translatable laterally toward said second end edge after insertion into said cutout after said at least one first flange has passed through said recess until said at least one first flange is disposed adjacent said first side while said ledge remains adjacent said second side;

said housing including a resilient beam extending outwardly from said first end wall spaced from said first face of said housing farther than said at least one first flange, to a free end defining a stop surface, and said stop surface being aligned with said first end edge when said resilient beam is undeflected, and said resilient beam having a length from said housing to said stop surface sufficient to be disposed between said first end edge and said first end wall when said resilient beam resiles after said housing is inserted through said cutout, whereby at least said free end of said resilient beam abuts and is deflected by a portion of said second side when said housing is initially inserted through said cutout, and resiles after said housing is translated laterally toward said second end edge thereby aligning said stop surface with said first end edge to prevent substantial inadvertent movement of said housing laterally toward said first end edge, thereby retaining said housing in said cutout while permitting incremental floating movement of said housing within said cutout to self-align with a mating connector during mating.

2. The connector as set forth in claim 1 wherein said panel-receiving gap is slightly greater than said thickness of said panel to permit incremental movement orthogonally with respect to a plane of said panel.

3. The connector as set forth in claim 1 wherein said ledge extends outwardly from said first end wall of said housing beside said resilient beam to abut said second side after said housing has been translated toward said second end wall.

4. The connector as set forth in claim 1 wherein said stop surface is defined by a latch projection of said resilient beam extending into said panel-receiving gap.

5. The connector as set forth in claim 4 wherein said stop surface latches with a locking edge of said panel that is defined on a locking tab bent out of the plane of said panel away from said second side.

6. The connector as set forth in claim 1 wherein said ledge includes a portion that extends outwardly from said second end wall of said housing.

7. The connector as set forth in claim 6 wherein said ledge is chamfered adjacent said panel-abutting surface facing said second face to prevent stubbing with edges of said panel defining sides of said recesses during translation of said housing.

8. The connector as set forth in claim 1 wherein said housing includes a plurality of said at least one first flange along each said side, each one of at least one first flange corresponding to a respective said recess of said cutout.

9. The connector as set forth in claim 8 wherein said at least one first flange includes a notch corresponding to an angled corner of a respective said recess for polarization.

10. The connector as set forth in claim 8 wherein said housing includes additional first flanges extending outwardly from said second end generally coplanar with said plurality of said at least one first flange.

11. The connector as set forth in claim 10 wherein side edges of said plurality of said at least one first flange and end edges of said additional first flanges are chamfered adjacent said panel-abutting surfaces to prevent stubbing with edges of said panel defining sides of said recesses during translation of said housing.

12. The connector as set forth in claim 8 wherein said ledge is defined by a plurality of second flanges.

13. The connector as set forth in claim 12 wherein side edges of said plurality of said second flanges are chamfered adjacent said panel-abutting surface facing said first face to prevent stubbing with edges of said panel defining sides of said recesses during translation of said housing.

14. The connector as set forth in claim 1 wherein said housing includes a plurality of terminals secured therein in respective cavities and having mating sections exposed along said first face and wire-connecting sections exposed along said second face, with said housing defining cavity portions that extend parallel to said second face for receipt thereinto of said wire-connecting sections after said wire-connecting sections have been crimped onto respective wires, defining a low profile.

15. The connector as set forth in claim 14 wherein said wire-connecting sections extend parallel to said second face and said cavity portions include wire-receiving grooves that extend to at least one said side wall of said housing, such that said wires exit said connector orthogonal to said second face.

16. The connector as set forth in claim 15 wherein said wire-receiving grooves are narrow to grip respective wires for maintaining said wires in position.

17. The connector as set forth in claim 1 wherein said at least one first flange is located adjacent said first face, whereby said connector defines a low profile along said first side.

18. The connector as set forth in claim 17 wherein said housing defines a shroud along said first face to receive thereinto a plug portion of a mating connector.

19. The connector as set forth in claim 17 wherein said mating connector is mounted to a second panel.

20. The connector as set forth in claim 19 wherein a plug portion of said mating connector extends orthogonally from first flanges thereof so that the distance between said panel and said second panel equals thicknesses of said at least one first flange of said connector and first flanges of said mating connector together.

* * * * *